US005139143A

United States Patent [19]

Pond

[11] Patent Number: 5,139,143

[45] Date of Patent: Aug. 18, 1992

[54] PADDED TOOL-CARRYING PORTFOLIO

[76] Inventor: William M. Pond, 102 Sweetwater St., Saugus, Mass. 01906

[21] Appl. No.: 688,268

[22] Filed: Apr. 22, 1991

[51] Int. Cl.[5] ..... B65D 85/00

[52] U.S. Cl. ..... 206/373; 206/523; 206/216; 206/233; 190/2

[58] Field of Search ..... 206/373, 372, 523, 216, 206/223; 190/2

[56] References Cited

U.S. PATENT DOCUMENTS

| | | | |
|---|---|---|---|
| 1,094,009 | 4/1914 | Parkhurst | 206/373 |
| 2,744,621 | 5/1956 | Kegevic | 206/16 |
| 3,143,748 | 8/1964 | Manning | 190/2 X |
| 3,513,969 | 5/1970 | Roff | 206/372 |
| 3,749,233 | 7/1973 | McCormick | 206/373 |
| 4,682,691 | 7/1987 | Spiering | 206/373 |
| 4,773,535 | 9/1988 | Cook | 206/373 |
| 4,836,374 | 6/1989 | Hutchins et al. | 206/523 |
| 4,901,464 | 2/1990 | Banoun | 206/373 |
| 4,951,812 | 8/1990 | Chen | 206/373 X |
| 4,989,734 | 2/1991 | Mode et al. | 206/373 |
| 5,002,401 | 3/1991 | Blackman | 206/372 X |

FOREIGN PATENT DOCUMENTS

| | | | |
|---|---|---|---|
| 2605298 | 8/1977 | Fed. Rep. of Germany | 206/523 |
| 2324422 | 4/1977 | France | 206/376 |
| 2535955 | 5/1984 | France | 206/372 |
| 571328 | 1/1976 | Switzerland | 206/373 |
| 103974 | 2/1917 | United Kingdom | 206/373 |
| 2228920 | 9/1990 | United Kingdom | 206/372 |

*Primary Examiner*—William I. Price
*Attorney, Agent, or Firm*—Pandiscio & Pandiscio

[57] ABSTRACT

A padded tool-carrying portfolio which comprises at least two relatively flat, planar leaves joined together by at least one hinge arrangement, wherein at least one of the at least two leaves comprises a tool-carrying surface which is adapted to carry a plurality of hand tools and other items thereon and to present them for easy grasping by the workman, and wherein at least one of the at least two leaves comprises a firm yet resilient padded mat for the workman to kneel on and which is relatively soft yet simultaneously provides adequate support for the workman's weight. During transport, the portfolio's at least two flat, planar leaves are closed together so that the at least two leaves face and engage one another. On site, the portfolio is opened up and laid down on the worksurface so as to present both the tool-carrying surface and the padded mat to the workman. As a result, the workman is able to effect repairs while comfortably kneeling on the clean soft surface of the portfolio's padded mat, with his most important hand tools positioned conveniently within reach.

13 Claims, 3 Drawing Sheets

PADDED TOOL-CARRYING PORTFOLIO

FIELD OF THE INVENTION

This invention relates to tool-carrying portfolios in general, and more particularly to padded tool-carrying portfolios.

BACKGROUND OF THE INVENTION

In many situations a workman must travel to a worksite and then work at that site adjacent a large piece of equipment or machinery to render repairs to that equipment or machinery. For example, an oil burner repairman generally needs to repair an oil burner on site in the basement of a home, or a road service mechanic frequently needs to repair a broken-down car or truck on the shoulder of a road or in a parking lot or driveway, or a photocopier or computer repairman frequently needs to repair a photocopier or computer in an office environment. In these circumstances, the workman typically carries with him a set of his most important, general-purpose (or trade specific) hand tools to be used in effecting the necessary repairs, and the workman frequently must kneel adjacent the piece of equipment or machinery while effecting the necessary repairs.

Unfortunately, conditions at many worksites may be such that the workman is forced to kneel on a hard, cold and dirty basement floor, or a hard, wet piece of pavement, or on a cold, gravelly road shoulder, etc. Kneeling on such a worksurface can be painful or even injurious to the workman, particularly where it occurs repetitively over a long period of time. In addition, kneeling on such a worksurface can result in dirty or ruined workclothes, and contribute to a messy and unprofessional appearance. This can be particularly true in the case of photocopier or computer repairmen who must frequently wear business suits and work in dusty office areas.

OBJECTS OF THE INVENTION

As a result, one of the objects of the present invention is to provide a padded tool-carrying portfolio which can be used to transport a workman's most important, general-purpose (or trade specific) hand tools to and from a worksite and, when opened at the worksite, will provide the workman with a clean, comfortable, thermally protected, non-conductive surface upon which to kneel, with the workman's tools being presented within easy reach of the workman.

Another object of the present invention is to provide a padded tool-carrying portfolio which will provide the workman with an on-site kneeling surface which is relatively soft yet which provides adequate support for the workman's weight.

Still another object of the present invention is to provide a padded tool-carrying portfolio which is simple and easy to make, and which is relatively inexpensive to produce.

SUMMARY OF THE INVENTION

These and other objects of the present invention are addressed by a novel padded tool-carrying portfolio which comprises at least two relatively flat, planar leaves joined together by at least one hinge arrangement, wherein at least one of the at least two leaves comprises a tool-carrying surface which is adapted to carry a plurality of hand tools and other items thereon and to present them for easy grasping by the workman, and wherein at least one of the at least two leaves comprises a firm yet resilient padded mat for the workman to kneel on and which is relatively soft yet simultaneously provides adequate support for the workman's weight. During transport, the portfolio's at least two flat, planar leaves are closed together so that the at least two leaves face and engage one another. On site, the portfolio is opened up and laid down on the worksurface so as to present both the tool-carrying surface and the padded mat to the workman. As a result, the workman is able to effect repairs while comfortably kneeling on the clean, soft surface of the portfolio's padded mat, with his most important hand tools positioned conveniently within reach.

BRIEF DESCRIPTION OF THE DRAWINGS

Still other objects and features of the present invention will be more fully disclosed or rendered obvious in the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 3:
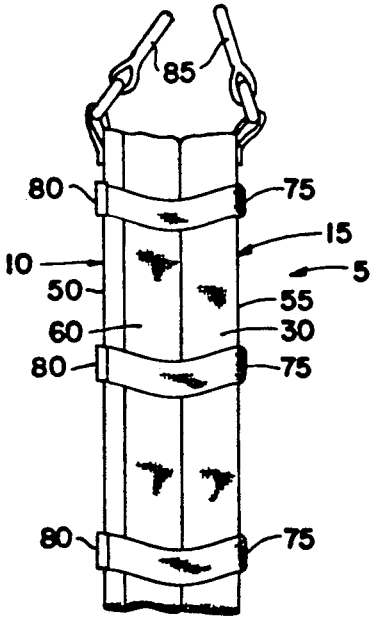
FIG. 3 is a side end view of one end of the same portfolio, with the portfolio being shown in its closed position.
Figure 4:
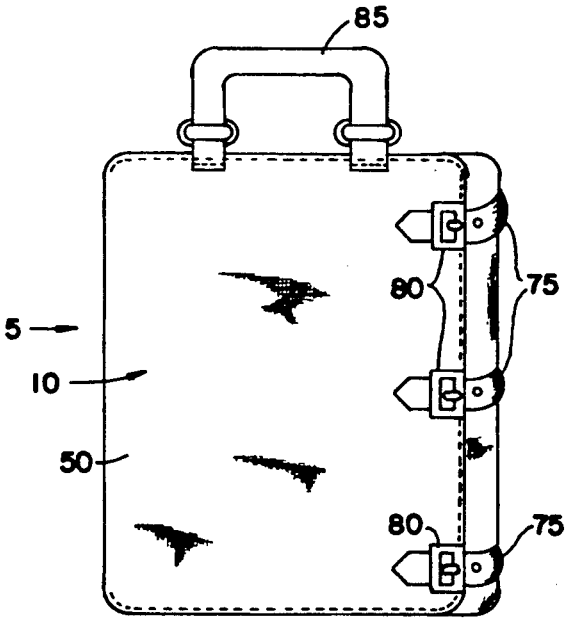
FIG. 4 is a side view in elevation of one side of the same portfolio, with the portfolio being shown in its closed position.
Figure 4A:
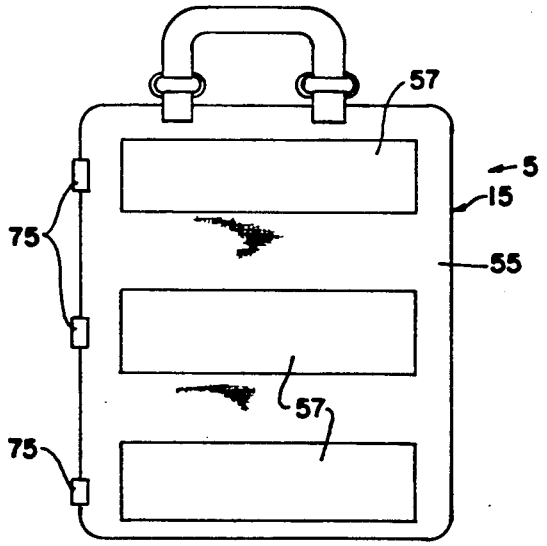
FIG. 4A is a side view in elevation of the other side of the same portfolio, with the portfolio being shown in its closed position.

Looking first at FIGS. 1–4, there is shown a padded tool-carrying portfolio 5 which comprises the preferred embodiment of the present invention. Portfolio 5 generally comprises three relatively flat, planar leaves 10, 15 and 20. Leafs 10 and 15 are connected together by a flexible hinge arrangement 25, and leafs 15 and 20 are connected together by a flexible hinge arrangement 30. In this way portfolio 5 can be opened up so as to expose its interior surfaces 35, 40 and 45 (FIG. 1), or closed up so as to present its exterior surfaces 50 and 55 (FIGS. 3 and 4). Preferably exterior surfaces 50 and 55 are formed out of a tough, scuff-resistant material so that they can survive the usual bumps encountered during transport and so that they can engage a variety of rough worksurfaces during use without suffering harm. Preferably exterior surfaces 50 and 55 are formed out of a material which is also waterproof so that the exterior surfaces 50 and 55 may provide some protection against worksurfaces which may also be wet. By way of example, in the preferred embodiment exterior surfaces 50 and 55 are formed out of a material such as DuPont's Cordura Plus. Preferably at least exterior surface 55 includes one or more rubber skid-resistant pads 57 (see FIG. 4A). Pads 57 help prevent portfolio 5 from sliding on a worksurface on which it is laid, and also helps protect exterior surface 55 (and any other surfaces to which pads 57 are applied) from unsightly scuffing. A gusset 60 (FIGS. 1-3) is adapted to fold over the outer end of leaf 10 when the portfolio is closed up, with gusset 60 having snaps 65 for engaging corresponding snap elements 70 carried by interior surface 35 of leaf 10 so as to hold the gusset in closed position. A plurality of straps 75 engage corresponding closures 80 (FIGS. 3 and 4) to keep the portfolio in its closed position, and a pair of handles 85 are provided to enable the workman to carry the closed portfolio to and from the worksite.

Interior surfaces 35 and 45 of planar leaves 10 and 20 each include a plurality of sleeves or pockets 90 (FIGS. 1 and 2) mounted thereon which are adapted to accommodate various hand tools (e.g. pliers, screwdrivers, etc.) within the sleeves and hold those tools on interior surfaces 35 and 45. Tool-capturing loops 95, which may or may not be attached to surfaces 35 and/or 45 by releasable attachment means such as Velcro fasteners, are preferably also provided. Closable pouches 100, for holding small parts, etc., may also be provided. It is to be appreciated that the sleeves 90, loops 95 and pouches 100 come in a variety of sizes and shapes so a to be able to accommodate a wide variety of tools and parts. In this respect, it is also to be appreciated the various sleeves 90 are carefully sized and shaped relative to the tools they are to receive, so that the sleeves will make a snug fit about their respective tools. As a result, the tools will be captured to leaves 10 and 20 (e.g. during transport) and yet may be pulled free of the leaves when they are to be used at the worksite by the workman. A tissue box 102 may also be provided (see FIG. 1).

Padding 101 (FIG. 2) may also be provided beneath surfaces 35 and 45 of leaves 10 and 20 to help protect the tools carried by the portfolio.

Interior surface 40 of planar leaf 15 includes a padded mat 105 (FIGS. 1 and 2) which preferably covers substantially all of surface 40. Padded mat 105 provides a kneeling surface for the workman at the worksite. Padded mat 105 is relatively soft, yet simultaneously provides excellent support for a workman's weight, so that the workman may comfortably kneel on the mat while working at a worksite and be protected from a cold, hard, wet underlying worksurface. It is important that padded mat 105 be soft enough to provide a comfortable kneeling surface, yet firm enough to provide stable support to the workman and to protect against a hard and/or irregularly-shaped underlying worksurface. Padded mat 105 is formed out of a firm yet resilient sheet material. The material may be a synthetic rubber or plastic material, preferably a closed cell foam material such as a closed cell polyethylene foam. By way of example, padded mat 105 might be formed out of a flexible, closed cell, polyethylene foam pad having an appropriate density, e.g. 2-6 pounds/cubic foot, and an appropriate thickness, e.g. 0.5-2 inches.

Preferably mat 105 is also formed out of a material providing substantial heat-insulating properties so as to also protect the workman from a cold (or hot) worksurface.

Preferably mat 105 is also formed out of a material having substantial vibration-insulating properties so as to also protect the workman from any vibrations present at the worksite.

Preferably mat 105 is also formed out of a material which is non-conductive.

By way of further example, it is believed that an excellent padded mat 105 can be formed out of one of the many closed cell polyethylene products sold by Halstead of Greensboro, N.C. under the tradename "therma-cel" or the tradename "INSUL-TUBE". Alternatively, it is believed that an excellent padded mat 105 can be formed out of closed cell foam product sold by Armstrong Industries of Braintree, Mass. under the tradename "ARMAFLEX II". (Such products are commonly used in sheet form for duct insulation and in rounded form for pipe insulation in the heating and air conditioning industry).

Figure 1:
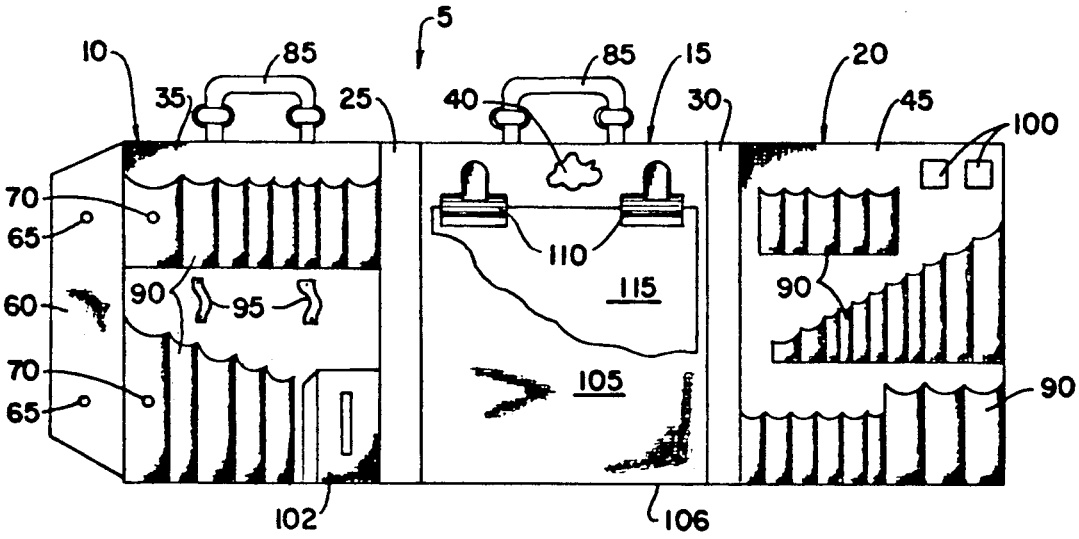
FIG. 1 is a plan view of the novel tool-carrying portfolio which comprises the preferred embodiment of the invention, with the portfolio being shown in its open position.
Figure 2:
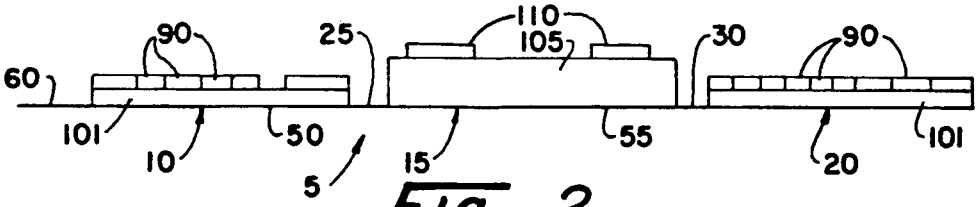
FIG. 2 is a bottom view of the bottom end of the same portfolio.

Still looking now at FIG. 1, a pair of clips 110 are mounted to planar leaf 15 such that clips 110 can hold replaceable sheets of clean kneeling papers 115 flat against the top surface of padded mat 105. By keeping a clean sheet of kneeling paper atop padded mat 105, the workman can ensure that he will always have a clean surface at the worksite on which to kneel.

(Alternatively, it is also anticipated that in some circumstances the user might be working at the worksite in a standing position, and might therefore be inclined to hang the portfolio in its open position from some sort of hook at the worksite; in this case, clips 110 could alternatively serve to hold up instruction sheets, schematics and the like for the easy inspection by the workman.)

Padded tool-carrying portfolio 5 is generally used as follows. The portfolio is first carried to the worksite in its closed position, i.e., so that gusset 60 is snapped over the outer end of leaf 10, leaf 20 is folded up against leaf 15 so that the sleeves or pockets 90 of leaf 20 face padded mat 105 of leaf 15, and leaf 10 is folded over leaf 20 so that the sleeves or pockets 90 of leaf 10 face the rear of leaf 20, with straps 75 cooperating with closures 80 to hold the portfolio closed. See FIGS. 2 and 3. In this closed position, the portfolio forms a neat, easy-to-carry case which holds the workman's tools and protects them during transport. In this respect, it should be appreciated that inasmuch as each of the leaves 10, 15 and 20 has a substantial degree of thickness (when viewed from the angle of view of FIG. 2), hinge arrangements 25 and 30 are adapted to provide a degree of spacing between the adjacent leaves so as to allow the leaves to fold up on one another in the manner shown in FIGS. 2 and 3. It is also to be appreciated that this folding procedure is also facilitated by the fact that at least mat 105, and also padding 101 if it is provided, is resilient in nature, and hence allows the leaves to be compressed together.

At the worksite, the portfolio is laid down on the ground and opened up so that its three leaves 10, 15 and 20 lie coplanar with one another, thereby presenting the padded mat 105 of leaf 15 and the tool-carrying leafs 10 and 20 to the workman. A fresh sheet of kneeling paper 115 is clipped to the padded mat 105 via the clips 110, and the workman then kneels on the padded mat 105, atop the fresh sheet of kneeling paper, and begins to work. Skid-resistant pads 57 help hold the portfolio against sliding on the worksurface. Inasmuch as padded mat 105 is relatively soft, yet simultaneously provides excellent support for the workman's weight, the workman will be able to comfortably kneel on the mat while working at the worksite and be protected from a cold, hard, wet underlying worksurface. Furthermore, since a fresh sheet of kneeling paper 115 is positioned atop padded mat 105, the workman always has a clean surface on which to kneel. In addition, the workman's most important hand tools, contained in the pockets 90 of leaves 10 and 20, are always present within easy reach of the workman.

At the conclusion of the work, the portfolio is closed back up into its closed position for easy transportation to the next worksite.

It is an important feature of the present invention that the workman have easy and unrestricted access to padded mat 105 when kneeling on the mat. To this end, it is critical that no rigid wall or barrier of substantial height be positioned at the bottom edge 106 (FIG. 1) of padded mat 105 which might inhibit access to the mat during use.

Of course, numerous modifications may be made to the preferred embodiment of the invention without departing from the scope of the present invention.

Figure 5:
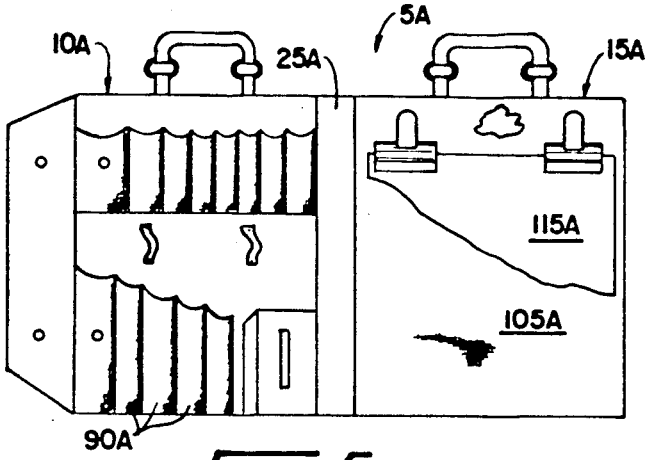
FIG. 5 is a plan view of another tool-carrying portfolio which comprises an alternative embodiment of the invention, with the portfolio being shown in its open position.

Thus, for example, and looking next at FIG. 5, there is shown an alternative padded tool-carrying portfolio 5A. Portfolio 5A is substantially identical to the portfolio 5 previously discussed, except that the third leaf 20 of portfolio 5 (and its associated parts) has been completely omitted. Portfolio 5A is more compact than portfolio 5, although it is able to carry less tools to and from the workplace.

It should also be appreciated that, in the case of a 2-leaf portfolio such as that shown in FIG. 5, the straps 75 and closures 80 of portfolio 5 could be replaced by perimeter zipper flaps and double tab zippers (not shown) of the sort common to 2-leaf portfolios and well known in the art to hold the portfolio in its closed position. Such an arrangement offers the additional advantage that the perimeter zipper flaps help protect the contents of the portfolio during transport, since the zippered flaps will cover the area between the parallel leafs 10A and 15A when the portfolio is in its closed position.

Figure 6:
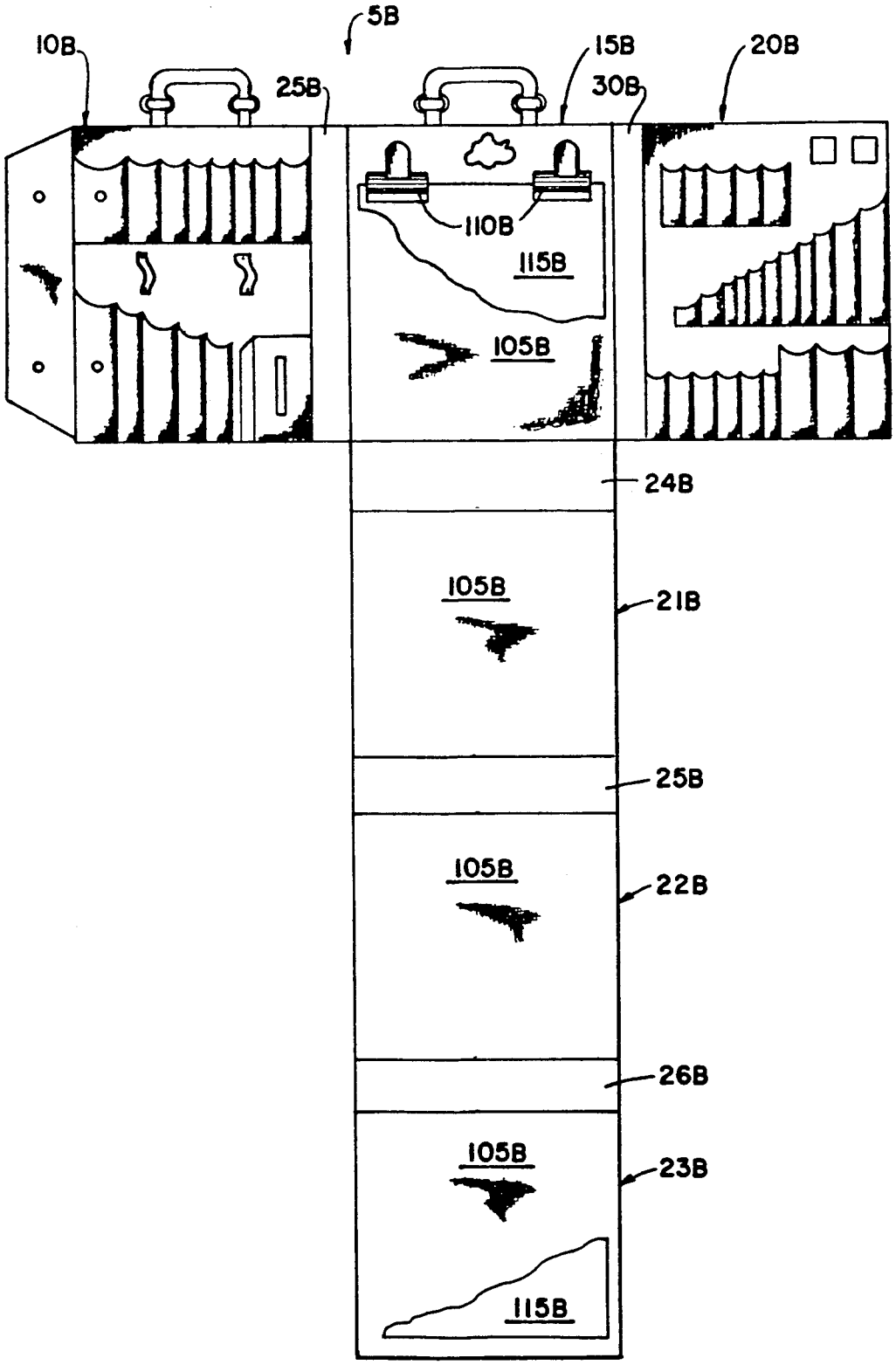
FIG. 6 is a plan view of still another tool-carrying portfolio which comprises an alternative embodiment of the invention, with the portfolio being shown in its open position.

Looking next at FIG. 6, there is shown an alternative padded tool-carrying portfolio 5B. Portfolio 5B is substantially identical to the portfolio 5 previously described, except that three additional leaves 21B, 22B and 23B are provided. Each of the leaves 15B, 21B, 22B and 23B carries thereon a padded mat 105B. Leaf 21B is flexibly hinged to leaf 15B by a hinge 24B, leaf 22B is flexibly hinged to leaf 21B by a hinge 25B, and leaf 23B is flexibly hinged to leaf 22B by a hinge 26B. During closure, leaf 23B is first folded over on leaf 22B at hinge 26B, then the combined leaves 22B and 23B are folded over on leaf 21B, then the combined leaves 21B, 22B and 23B are folded over on leaf 15B at hinge 24B, and then leaves 20B and 10B are folded over in the manner previously described, and the various leaves are secured in position through the usual straps and closures (not shown in FIG. 6). At the worksite, the portfolio is set down on the ground and then opened, in the manner shown in FIG. 6; the padded mats 105B of leaves 15B, 21B, 22B and 23B then provide a padded worksurface which the workman can lie down on. Again, clips 110B allow a long sheet of paper 115B to be placed atop the padded mats 105B to assure a clean surface for the workman to lie atop.

Figure 7:
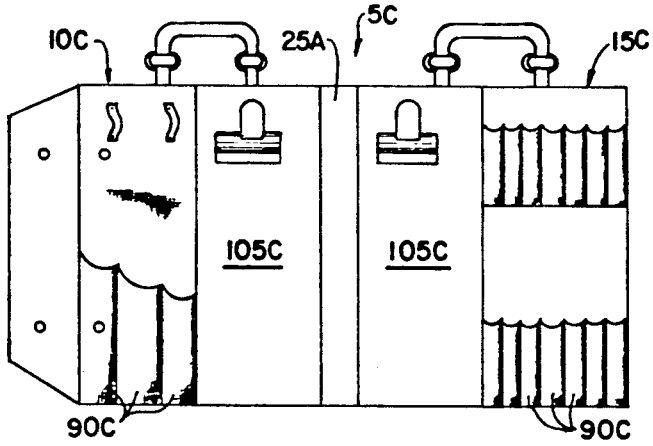
FIG. 7 is a plan view of yet another tool-carrying portfolio which comprises an alternative embodiment of the invention, with the portfolio being shown in its open position.

Looking next at FIG. 7, there is shown another padded tool-carrying portfolio 5C. Portfolio 5C is similar to the portfolio 5A shown in FIG. 5, except that a portion of leaf 10C is provided with tool-carrying pockets 90C and portion of leaf 10C is provided with a padded mat 105C, and except that a portion of leaf 15C is provided with tool-carrying pockets 90C and a portion of leaf 10C is provided with a padded mat 105C. The workman uses portfolio 5C by placing one knee on the padded mat 105C of leaf 10C and one knee on the padded mat 105C of leaf 15C.

ADVANTAGES OF THE INVENTION

Numerous advantages are achieved by using the present invention.

For one thing, the present invention provides a padded tool-carrying portfolio which can be used to transport a workman's most important, general-purpose (or trade specific) hand tools to and from a worksite and, when opened at the worksite, will provide the workman with a clean, comfortable, thermally protected, non-conductive surface upon which to kneel, with the workman's tools being presented within easy reach of the workman.

For another thing, the present invention provides a padded tool-carrying portfolio which will provide the workman with an on-site kneeling surface which is relatively soft yet which provides adequate support for the workman's weight.

And the present invention provides a padded tool-carrying portfolio which is simple and easy to make, and which is relatively inexpensive to produce.

What is claimed is:

1. A padded tool-carrying portfolio comprising:

at least two relatively flat, planar leaves joined together by at least one hinge arrangement such that said at least two leaves can be positioned in a closed position in which said at least two leaves are disposed parallel to and in stacked relation to one another, and an open position in which said at least two leaves are disposed adjacent to and coplanar with one another, at least one of said at least two leaves comprising a tool-carrying surface having means to carry a plurality of tools thereon and to present said tools for grasping when said at least two leaves are positioned in said open position, and at least one of said at least two leaves comprising a padded mat of firm yet resilient material which is adapted to provide a soft yet supportive surface to be knelt on when said at least two leaves are positioned in said open position.

2. A padded tool-carrying portfolio according to claim 1 wherein said portfolio further comprises releasable fastening means for releasably maintaining said portfolio in its said closed position.

3. A padded tool-carrying portfolio according to claim 1 wherein said portfolio further comprises handle means for carrying said portfolio when it is in its said closed position.

4. A padded tool-carrying portfolio according to claim 1 wherein said padded mat is formed out of flexible, closed cell foam pad.

5. A padded tool-carrying portfolio according to claim 4 wherein said foam pad has a density of approximately 2–6 pounds/cubic foot, and a thickness of 0.5–2 inches.

6. A padded tool-carrying portfolio according to claim 1 wherein said padded mat provides substantial heat-insulating properties.

7. A padded tool-carryinq portfolio according to claim 1 wherein said padded mat provides substantial vibration-insulating properties.

8. A padded tool-carrying portfolio according to claim 1 wherein said padded mat is formed out of a material which is non-conductive.

9. A padded tool-carrying portfolio according to claim 1 wherein at least one of said at least two leaves is waterproof.

10. A padded tool-carrying portfolio according to claim 1 wherein said portfolio comprises first, second and third leaves, and first and second hinge arrangements, said first leaf being joined to said second leaf by said first hinge arrangement, and said second leaf being joined to said third leaf by said second hinge arrangement.

11. A padded tool-carrying portfolio according to claim 10 wherein said first and third leaves each comprises a tool-carrying surface having means to carry tools, and said second surface comprises a kneeling surface.

12. A padded tool-carrying portfolio according to claim 1 wherein said portfolio comprises first and second leaves, and a hinge arrangement, said first leaf being joined to said second leaf by said hinge arrangement.

13. A padded tool-carrying portfolio according to claim 11 wherein said first leaf comprises a tool-carrying surface having means to carry tools, and said second leaf comprises a kneeling surface.

* * * * *